US006006627A

United States Patent [19]

Ikeda et al.

[11] Patent Number: 6,006,627

[45] Date of Patent: Dec. 28, 1999

[54] OPERATION LEVER UNIT FOR ENGINE-POWERED WORKING MACHINE

[75] Inventors: Takashi Ikeda; Kenjiro Hiratsuna; Kenji Higashi; Atsushi Kojima, all of Wako, Japan

[73] Assignee: Honda Giken Kogyo Kabushiki Kaisha, Tokyo, Japan

[21] Appl. No.: 09/096,161

[22] Filed: Jun. 11, 1998

[30] Foreign Application Priority Data

Jun. 27, 1997 [JP] Japan ..... 9-172400

[51] Int. Cl.[6] ..... G05G 11/00; G05G 5/06; F16C 1/12

[52] U.S. Cl. ..... 74/531; 74/480 R; 74/501.6

[58] Field of Search ..... 74/531, 480 R, 74/523, 501.6, 526

[56] References Cited

U.S. PATENT DOCUMENTS

| | | | |
|---|---|---|---|
| 5,664,543 | 9/1997 | Taomo et al. | 74/501.6 X |
| 5,765,445 | 6/1998 | Miyata | 74/501.6 X |
| 5,862,713 | 1/1999 | Tsunoda et al. | 74/526 |
| 5,868,377 | 2/1999 | Taomo et al. | 74/501.6 X |

FOREIGN PATENT DOCUMENTS

| | | |
|---|---|---|
| 53-42661 | 10/1978 | Japan . |
| 55-21536 | 5/1980 | Japan . |
| 60-41539 | 3/1985 | Japan . |
| 63-14035 | 4/1988 | Japan . |

*Primary Examiner*—Tamara L. Graysay
*Assistant Examiner*—Colby Hansen
*Attorney, Agent, or Firm*—Merchant & Gould P.C.

[57] ABSTRACT

An operation lever unit includes an operation handle attached to an operating rod of an engine-powered portable working machine. The operation handle is equipped with a throttle lever for regulating the power of an engine, a lock lever for holding the throttle lever in a desired position, and a secondary throttle adjustment lever for achieving a fine adjustment of the position of the throttle lever. To hold the throttle lever in the desired position, the throttle lever is forced against a portion of the operation handle by the action of a thrust cam mechanism disposed between the throttle lever and the lock lever. For achieving the fine adjustment of the throttle lever position, the secondary throttle adjustment lever is forced by a thumb of the operator to forcibly turn the throttle lever against a frictional force acting between the throttle lever and the handle portion.

6 Claims, 8 Drawing Sheets

OPERATION LEVER UNIT FOR ENGINE-POWERED WORKING MACHINE

BACKGROUND OF THE INVENTION

1. Field of the Invention

The present invention relates generally to an operation lever unit for engine-powered working machines, and more particularly to a throttle lever unit provided on a rod of a carrying bush cutter having a circular cutter driven in rotation by an engine carried on the back of an operator.

2. Description of the Related Art

A carrying bush cutter having a circular cutter attached to the top of a hand-operating rod and driven in rotation by an engine carried on the back of an operator for achieving a bush-removing work is disclosed in, for example, Japanese Utility Model Publication No. SHO 63-14035. In use of the disclosed bush cutter, the operator swings the rod in vertical and horizontal directions while gripping an operation handle provided on the rod, so as to remove bushes by the rotating circular cutter. In order to control the rotational speed of the cutter, output power of the engine is regulated by a throttle lever provided on a grip portion of the operation handle.

Disadvantageously, because the operator is forced to continue gripping of the throttle lever together with the operation handle throughout a bush-removing work, a heavy work load is put on the operator.

Somewhat successful prior improvements have proposed a lock mechanism associated with the throttle lever to lock the throttle lever in a desired position to thereby reduce the work load on the operator. Typical examples of the prior improvements are disclosed in Japanese Utility Model Publications Nos. SHO 53-42661, SHO 55-21536 and SHO 60-41539.

According to the disclosed operating lever units, the throttle lever is displaced to a predetermined operating position, then locked in this operating position by activating the lock mechanism. The lock mechanism is released at need.

More specifically, the operation lever unit disclosed in Japanese Utility Model Publication No. SHO 55-21536 is constructed such that when a throttle adjustment is needed, the throttle lever is turned by the thumb or the second finger of a hand of the operator while the operation handle and an unlock lever are continuously gripped by the same hand. Actuation of the throttle lever using a single finger is unable to guarantee smooth and reliable movement of the throttle lever in both the throttle-opening direction and the throttle-closing direction.

The operation lever unit disclosed in Japanese Utility Model Publication No. SHO 60-41539 is designed such that when a throttle adjustment is needed, a lock lever is turned to a given position by using the second finger of a hand of the operator and the throttle lever is turned to a desired position by the second finger. During that time, the operation handle is continuously gripped by the same hand. Actuation of the two levers using a single finger is insufficient to provide a smooth and reliable movement of the throttle lever in both the throttle-opening direction and the throttle-closing direction.

The operation lever unit disclosed in Japanese Utility Model Publication No. SHO 53-42661 is designed such that when a throttle adjustment is needed, a throttle trigger is actuated by the thumb while gripping the operation handle together with a safety tripper. Likewise the operation lever units shown in Japanese Utility Model Publication Nos. SHO 55-21536 and SHO 60-41539, the throttle adjustment disclosed in this Japanese Publication relies on the use of a single finger. Accordingly, a precise throttle adjustment is difficult to achieve.

In general, the bush cutter while in use for bush-removing operation is subjected to various sorts of vibrations caused due, for example, to running of the engine, rotation of a drive shaft extending through the operating rod, and rotation of the circular cutter. In order to keep a satisfactory level of working efficiency, the operator is required to continue a firm grip on the operation handle throughout the bush-removing work.

SUMMARY OF THE INVENTION

It is accordingly an object of the present invention to provide an operation lever unit including structural features which enable an easy and precise adjustment of the throttle lever while keeping a firm grip on the operation handle on which the throttle lever is provided.

According to the present invention, there is provided an operation lever device for regulating the power of an engine of a working machine to control operation of a working tool attached to one end of an operating rod of the working machine, the operation lever unit comprising: an operation handle provided on an opposite end portion of the operating rod and having a retaining surface and a support shaft extending perpendicularly from the retaining surface; a throttle lever having an end pivotally connected to the operation handle and extending over the retaining surface, the throttle lever being pivotally movable about the pivoted end within a predetermined angular range; a lock lever pivotally supported on the support shaft; a thrusting means disposed between the throttle lever and the lock lever and responsive to pivotal movement of the lock lever for forcing the throttle lever against the retaining surface to frictionally hold the throttle lever in a desired position; and a secondary throttle adjustment lever provided on the throttle lever for forcibly turning the throttle lever against a frictional force acting between the throttle lever and the retaining surface of the operation handle.

In use, the operation handle of the operation lever unit is gripped by a hand of the operator. In this instance, the throttle lever and the lock lever are also gripped together with the operation handle. The throttle lever is therefore pivotally moved toward a throttle-opening direction, and the lock lever is turned into a locking position. In response to the angular movement of the lock lever, the thrusting means forces the throttle lever against the retaining surface of the operation handle to thereby frictionally hold the throttle lever in a desired position. When a fine adjustment of the throttle is needed, the secondary throttle adjustment lever is displaced by forcing it with the thumb to thereby turn the throttle lever in a throttle-closing direction during which time a grip on the operation handle is maintained.

The operation handle extends perpendicularly from a longitudinal axis of the operating rod. The throttle lever is disposed on one side of the operation handle which faces toward the working tool. The lock lever is disposed on an opposite side of the operation handle which faces away from the working tool. The secondary throttle adjustment lever is disposed on a surface of the operating handle extending substantially parallel to the longitudinal axis of the operating rod. With this arrangement, when the operation handle including the throttle lever and the lock lever is gripped like a gun, the throttle lever is depressed by the second and third fingers while the lock lever is depressed by a ball of the thumb. One side of the operation handle is held in contact with a palm of the hand. The operation handle can, therefore, be gripped stably and firmly. The secondary throttle adjustment lever is actuated by the thumb which does not take part in the gripping of the operation handle including the throttle lever and the lock lever. A fine adjustment of the throttle can readily be achieved by actuating the secondary throttle adjustment lever with one finger without loosening a grip on the operation handle.

The operation handle preferably has a pocket in which a lever portion of the lock lever is received when the lock lever is gripped together with the operation handle.

The thrusting means preferably includes a rotary cam integral with the lock lever and rotatably mounted on the support shaft, and a slide cam slidably and non-rotatably mounted on the support shaft. The slide cam is disposed between the throttle handle and the rotary cam and has a cam surface, The rotary cam has a cam surface which coacts with the cam surface of the slide cam to move the slide cam along the support shaft in a direction toward the retaining surface when the rotary cam is turned about the support shaft by the lock lever. With this axial sliding movement of the slide cam, the throttle lever is forced into face-to-face contact with the retaining surface of the operation handle. The thrusting means further includes a resilient member disposed between the throttle lever and the slide cam to urge them away from each other. Preferably, the resilient member is a pair of conical spring washers fitted around the support shaft in face-to-face or back-to-back confrontation.

The above and other features and advantages of the present invention will become manifest to these versed in the art upon making reference to the detailed description and the accompanying sheets of drawings in which a preferred structural embodiment incorporating the principles of the invention is shown by way of illustrative examples.

DETAILED DESCRIPTION OF THE PREFERRED EMBODIMENT

Figure 1:
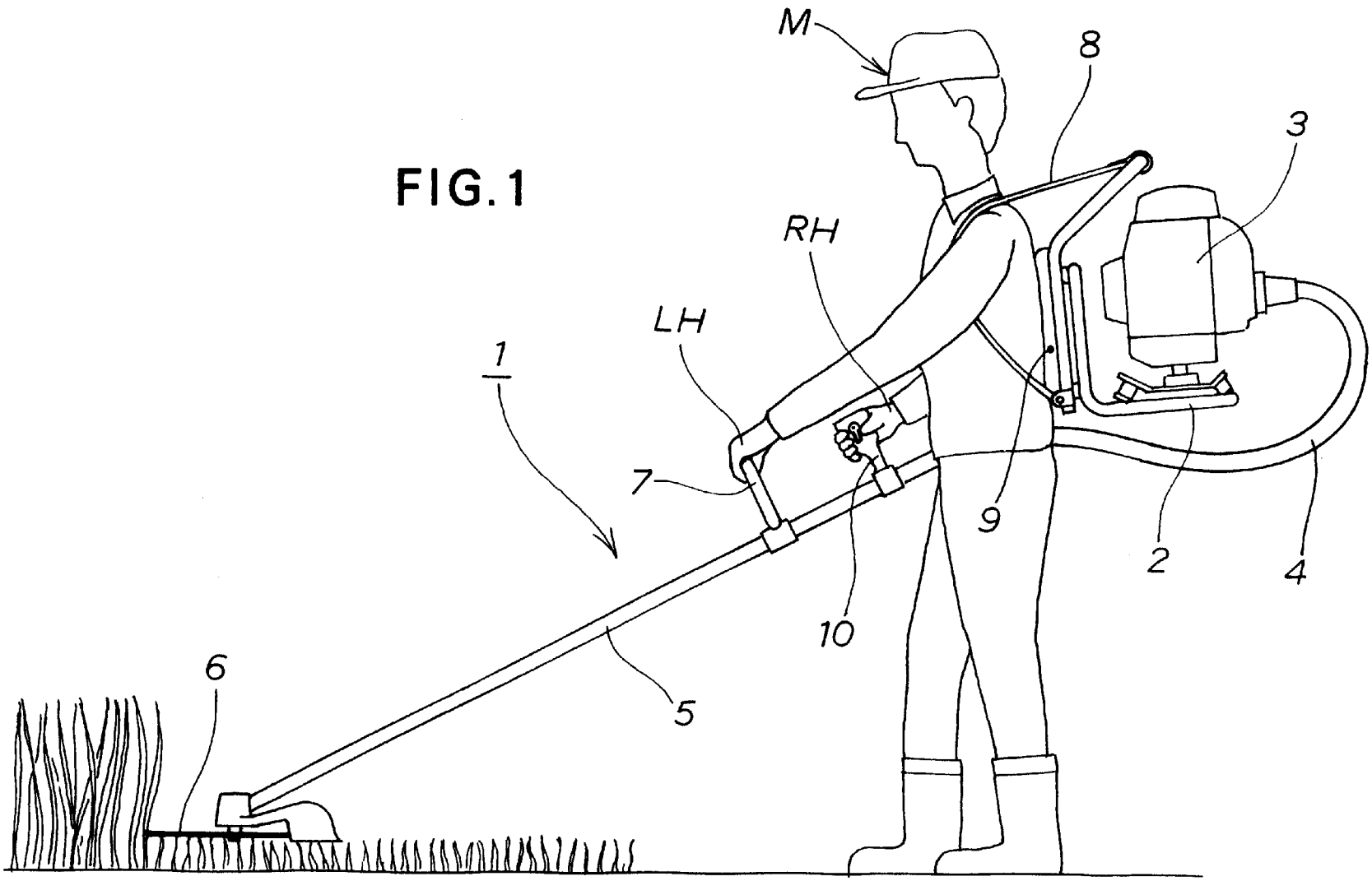
FIG. 1 is a diagrammatical view of a carrying bush cutter as it is used in a bush-removing work as a working machine embodying the present invention.

FIG. 1 shows a carrying bush cutter 1 having a frame 2 on which a power unit such as a gasoline engine is mounted. The power unit or engine 3 has an output shaft connected to an end of a flexible tube 4. The other end of the flexible tube 4 is connected to one end (proximal end) of an elongated rigid hollow operating rod 5. A circular cutter (working tool) 6 is rotatably attached to the other end (distal end) of the operating rod 5. The circular cutter 6 is driven in rotation by a drive shaft (not shown) which extends longitudinally through the operating rod 6 and the flexible tube 4 and is driven by output power of the engine 3.

The operating rod 5 has a grip handle 7 and an operation handle 10 that are located at the proximal end portion of the operating rod 5 with the operation handle 10 disposed in front of the grip handle 7 when viewed from the proximal end of the operating rod 5. The grip handle 7 and the operation handle 10 extend upright from an upper surface of the operating rod 5.

The frame 2 has a pair of belts or straps (one being shown in FIG. 1) 8 for enabling the operator M to carry the engine 3 on its back, with a cushioning pad 9 disposed between the back of the operator and the frame 2. In use, the operating rod 5 is held on, for example, the right side of a body of the operator M, with the grip handle 7 and the operation handle 10 being gripped by the left hand LH and the right hand RH of the operator M, respectively. The operating rod 5 is swung by right and left and up and down about its proximal end to thereby perform a bush-removing operation.

The left hand LH of the operator M is used essentially for gripping the grip handle 7 and moving the operating rod 5 right and left and up and down. The right hand RH of the operator M is used not only for gripping the operation handle 10 but also for performing the throttle adjustment to regulate output power of the engine 3.

As shown in FIGS. 2 through 6, the operating handle 10 has a casing 11 composed of a pair of symmetrical left and right casing halves or members 11A and 11B connected together to define an internal space of the casing 11 in which various parts of an operating lever unit are received. The casing 11 has a tubular body 12 secured by a bracket 5*a* to the operating rod 5, and an enlarged head 15 formed integrally with an upper end of the body 12. The tubular body 12 is formed jointly by respective lower portions 11*a*, 11*a* of the casing members 11A, 11B.

Each of the casing members 11A, 11B has an intermediate portion 11*b* recessed at its rear side (right-hand side in FIGS. 2 and 3) so as to form a vertically extending recessed portion 11*c*. When the casing members 11A, 11B are connected together, the recessed portions 11*c* jointly form a pocket 13 in the vicinity of a rear upper end of the tubular body 12. The pocket 13 is receptive of a lever portion 40*a* of a lock lever 40.

The casing members 11A, 11B each have a cutout portion 11*d* formed in a sloped rear wall of the head 15 extending upwardly and outwardly from an upper end of the recessed portion 11*c*. When the casing members 11A, 11B are assembled together, the cutout portions 11*d*, 11*d* jointly form an elongated hole 14 (FIG. 3) which permits pivotal movement of the lever portion 40*a* of the lock lever 40.

Figure 4:
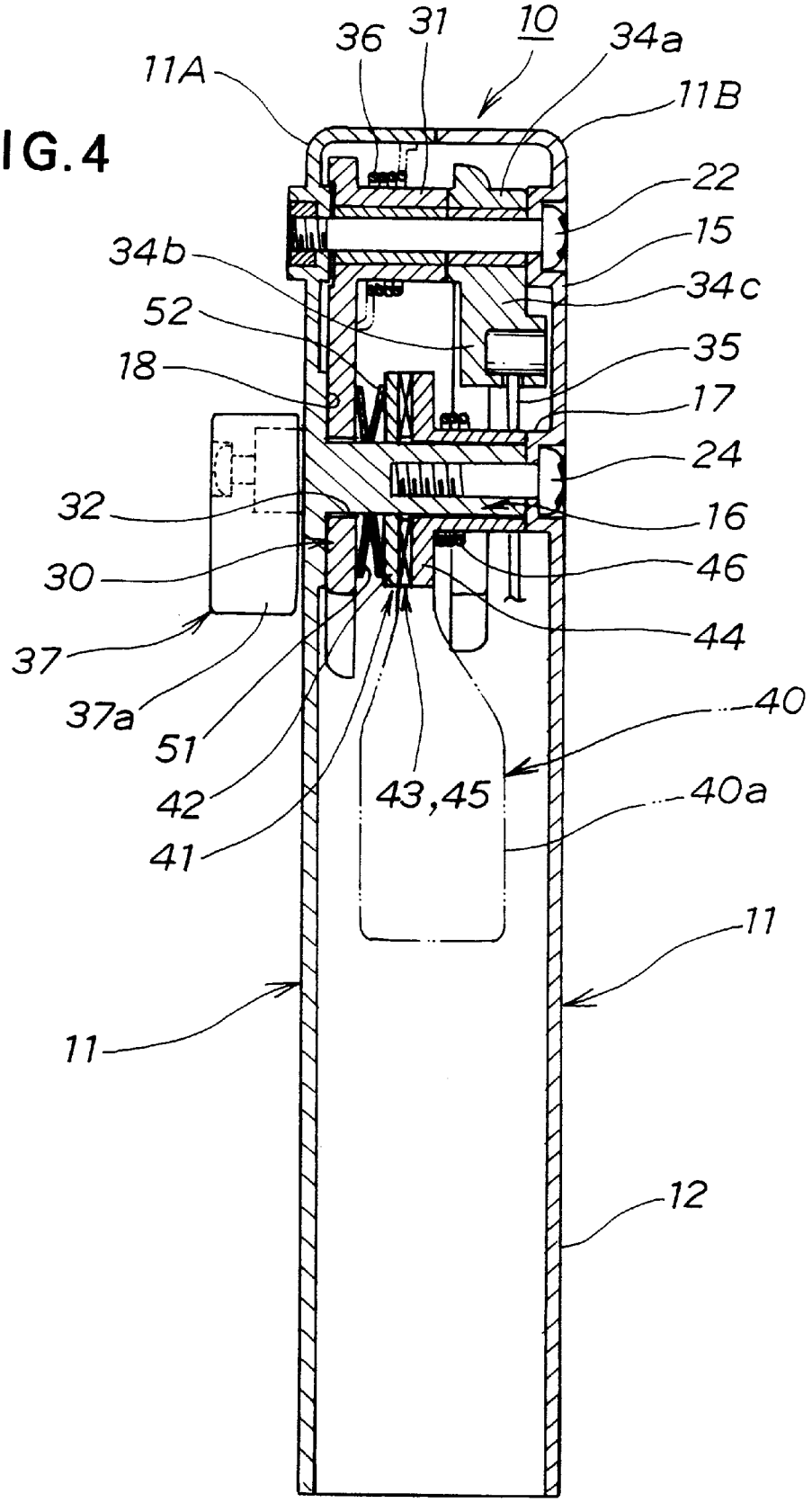
FIG. 4 is a longitudinal cross-sectional view of the operation lever unit when viewed from the rear side thereof.

The left casing member 11A has a support shaft 16 projecting perpendicularly from an inside surface of the head 15 toward the right casing member 11B. The support shaft 16 has a circumferential surface cut or removed at its diametrically opposite portions so as to form a pair of flat surfaces. The support shaft 16 has a non-circular cross-sectional shape. The inside surface of the left casing member 11A is raised at a portion extending around a base portion of the support shaft 16 so as to form a flat retaining surface 18 (FIG. 4). The right casing member 11*b* has a circular retaining seat 17 projecting from an inside surface thereof and is aligned with the support shaft 16. When the left and right casing members 11A, 11B are assembled together, an end surface of the support shaft 16 is held in abutment with the retaining seat 17.

Figure 2:
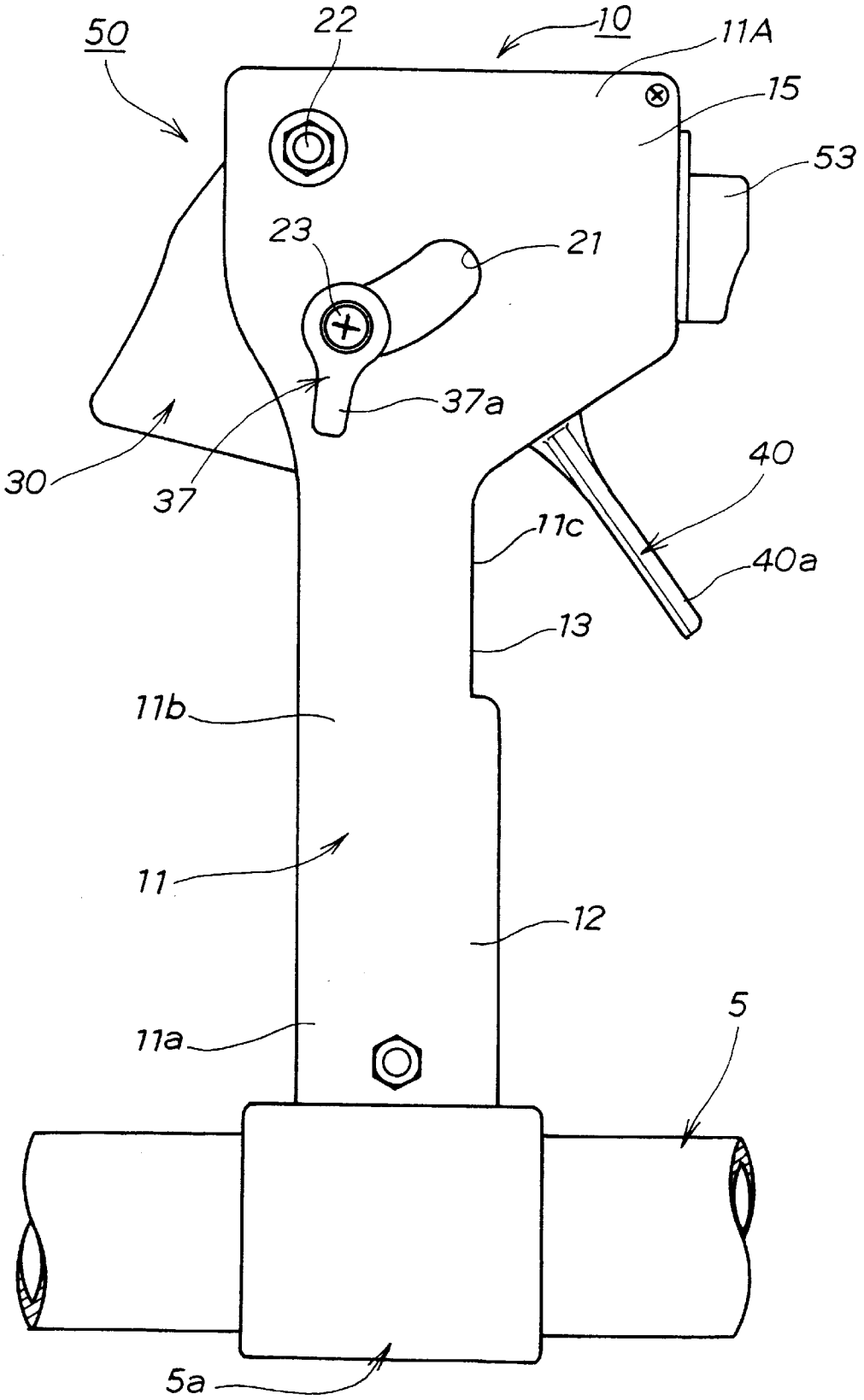
FIG. 2 is a side view of an operation lever unit including an operation handle of the bush cutter, the view showing a throttle lever and a lock lever in their original positions.
Figure 3:
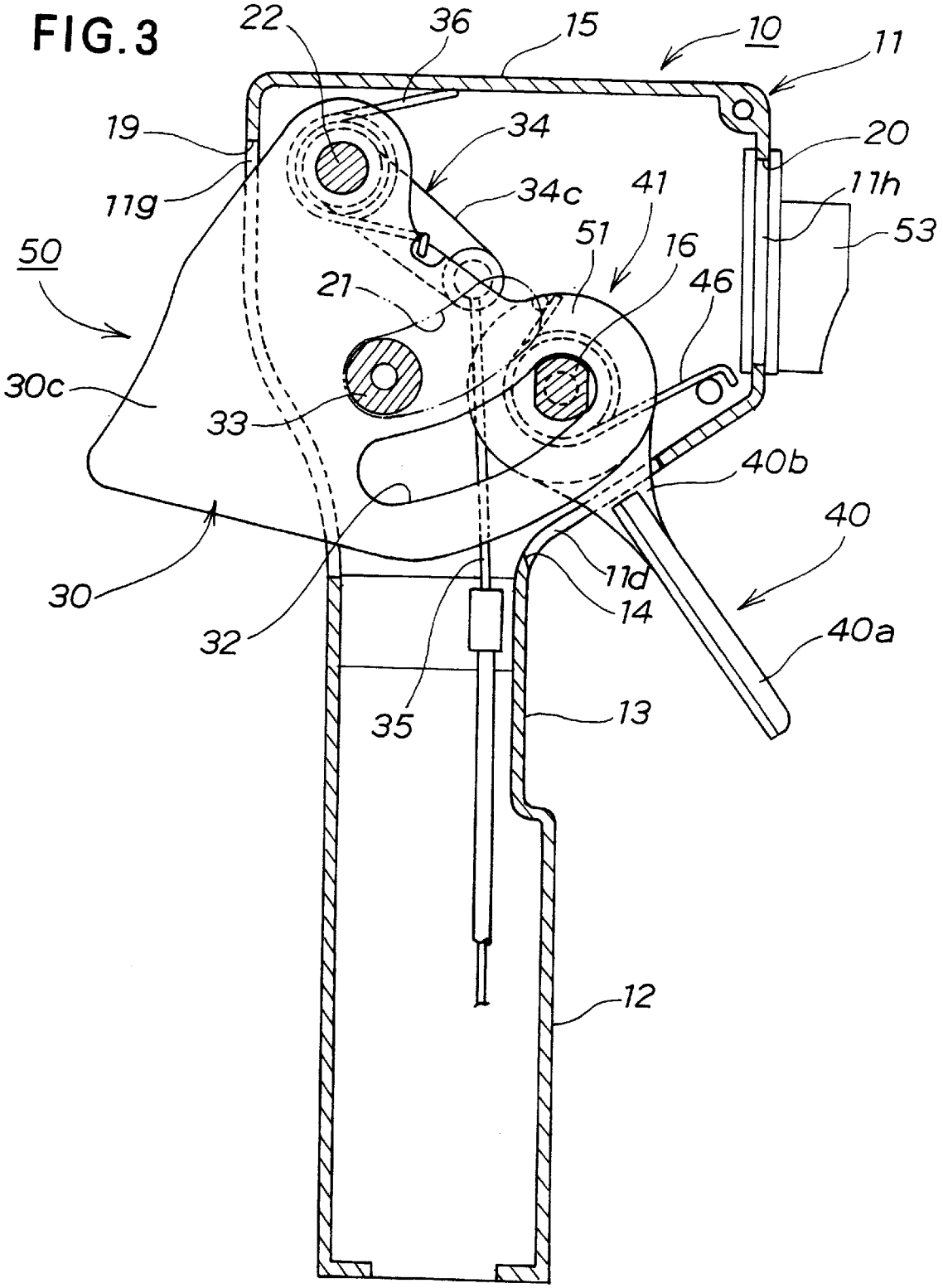
FIG. 3 is a longitudinal cross-sectional view of FIG. 2, showing the internal structure of the operation lever unit.
Figure 5:
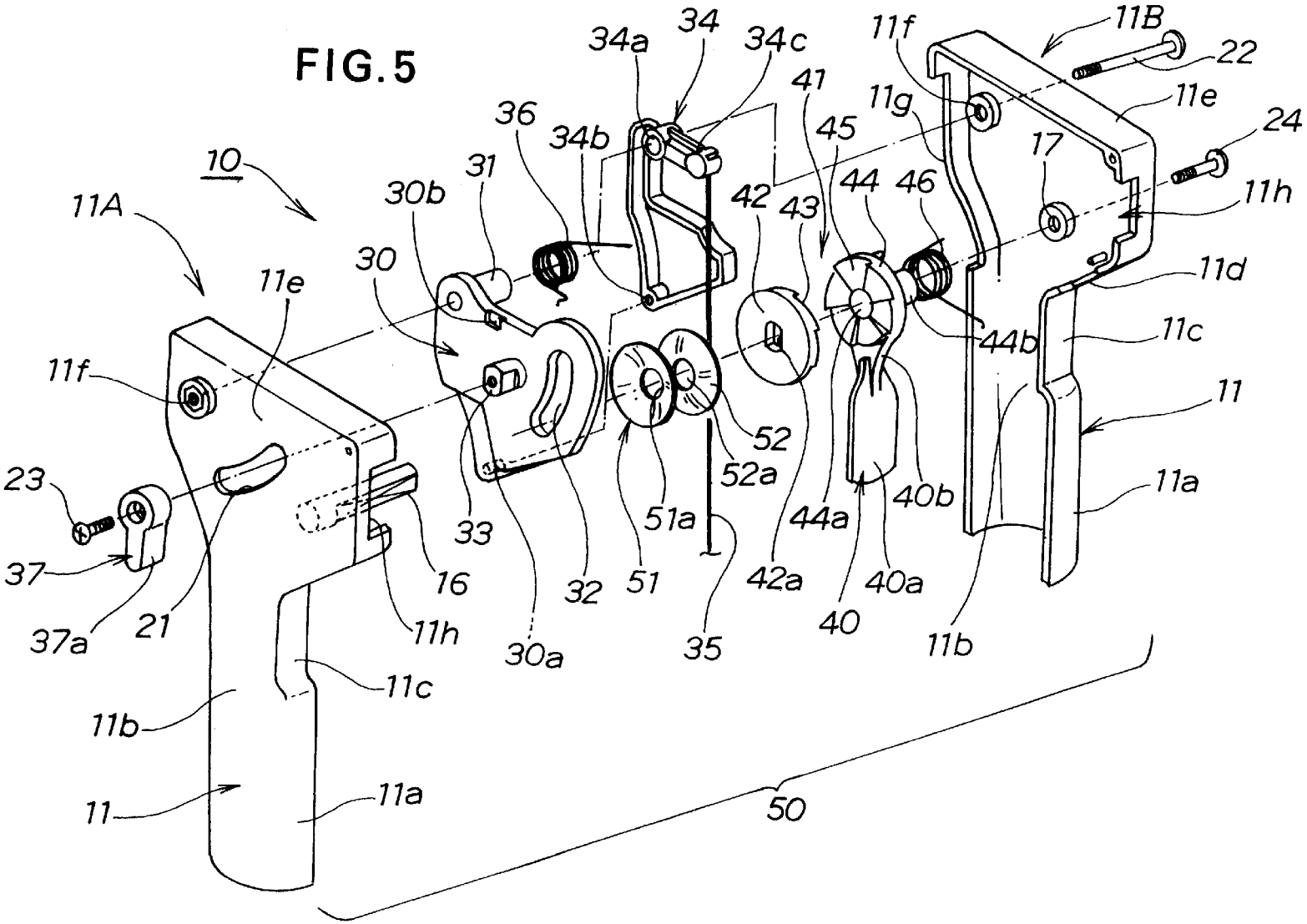
FIG. 5 is an exploded perspective view of the operation lever unit.

The casing members 11A, 11B have a pair of aligned support holes 11*f*, 11*f* formed in upper portions 11*e*, 11*e* thereof. The front side (left-hand side in FIGS. 2 and 3) of each casing member 11A, 11B has a cutout portion 11*g* extending in a longitudinal direction of the handle 10, as shown in FIG. 5. When the left and right casing members 11A, 11B are assembled together, the cutout portions 11*g*, 11*g* jointly form a vertically extending elongated hole 19 at a front side of the head 15, as shown in FIG. 3.

Additionally, each of the casing members 11A, 11B has a cutout portion 11*h* formed at the rear side of the upper portion 11*e*. When the casing members 11A, 11B are assembled together, the cutout portions 11*h*, 11*h* jointly form an elongated hole 20 at the rear side of the head 15, as shown in FIG. 3. The upper portion 11*e* of the left casing member 11A further has an arcuate guide hole 21 extending arcuately about a center of the support hole 11*f* of the left casing member 11A.

The operation handle 10 is formed by assembled together the left and right casing members 11A, 11B. The operating handle 10 houses therein essential parts of a throttle lever 30 and essential parts of the lock lever 40.

The throttle lever 30 is generally in the form of a sector of a circle (i.e., fan-like shape) and has a tubular shaft 31 (FIG. 5) formed integrally with an upper end of the fan-shaped or sectoral throttle lever 30, and an arcuate guide hole 32 extending arcuately about a center of the tubular shaft 31 along an arcuate lower peripheral edge portion of the sectoral throttle lever 30. The tubular shaft 31 formed on one side of the throttle lever 30 facing toward the right casing member 11B. The opposite side of the throttle lever 30 has formed thereon a guide pin 33 slidably received in the arcuate guide hole 21 of the left casing member 11A.

A throttle actuator 34 is attached to the throttle lever 30 for actuating a throttle valve (not shown) of the engine 3 (FIG. 19 via a throttle control cable 35 (FIG. 5). The throttle actuator 34 and the throttle lever 30 are connected together by a bolt 22 extending through the support hole 11*f* in the right casing member 11B, a through-hole 34*a* formed in an upper portion of the throttle actuator 34, and the support hole 11*f* in the left casing member 11B. The bolt 22 is engaged threadedly with a nut firmly received in the support hole 11*f* of the left casing member 11A. The bolt 22 serves as a pivot shaft about which the throttle lever 30 turns. The throttle lever 30 has a pin 30*a* projecting laterally from a lower portion thereof and fitted in an engagement hole 34*b* formed in a lower portion of the throttle actuator 34. Thus, the throttle lever 30 and the throttle actuator 34 are pivotally movable about the bolt 22 as a single unit.

The throttle control cable 35 is connected at its one end to a stay 34*c* formed at the upper portion of the throttle actuator 34 and, at the other end, to the throttle valve of the engine 3 (FIG. 1). With this arrangement, when the throttle lever 30 is turned about the bolt (pivot axis) 22 in the counterclockwise direction of FIG. 5, the throttle actuator 34 turns about the bolt 22 in the same direction to pull the throttle control cable 35 upwards, whereby the throttle valve of the engine 3 is opened widely to increase power of the engine 3 to thereby speed up rotation of the cutter 6 (FIG. 1).

The throttle lever 30 is normally urged in the original position of FIG. 3 by the force of a torsion coil spring 36 fitted around the tubular shaft 31 as a first return spring. The return spring 36 has one end engaged with the casing 11 and the other end engaged with a retaining recess 30*b* formed at an upper edge of the throttle lever 30. With the return spring 36 thus provided, the throttle lever 30 can automatically return to its original position shown in FIG. 3 as soon as a grip on the throttle lever 30 is loosened or released.

A secondary throttle adjustment lever 37 is firmly secured by a screw 23 to an end of the guide pin 33 slidably received in the arcuate guide hole 21 of the left casing member 11A. The secondary throttle adjustment lever 37 is disposed on the outside surface of the head 15 of the operation handle 10, as shown in FIG. 2. The secondary throttle adjustment lever 37 has a size which enables a lever portion 37*a* to be pushed and pulled by a thumb of the right hand RH (FIG. 1) of the operator M.

The support shaft 16 extends through the arcuate guide hole 32 of the throttle lever 30 and supports thereon a thrust cam mechanism 41 disposed between the throttle lever 30 and the right casing member 11B, with a pair of conical spring washers 51, 52 disposed in top-to-top confrontation between the throttle lever 30 and the thrust cam mechanism 41, as shown in FIG. 4. The conical spring washers 51, 52 each have a circular central hole 51*a*, 51*b* fitted around the support shaft 16. The thrust cam mechanism 41 and the conical spring washers 51, 52 jointly form a thrusting means.

The thrust cam mechanism 41 is comprised of a slide cam 42 and a rotary cam 44. The slide cam 42 is a circular disk cam having on its one end face a plurality of sloped cam surfaces 43 arranged in a circumferential direction of the disk cam (slide cam) 42. The rotary cam 44 is also a circular disk cam having a plurality of sloped cam surfaces 45 arranged in a circumferential direction on its one end face confronting the cam surfaces 43 of the slide cam 42. The sloped cam surfaces 43 of the slide cam 41 has a profile complementary in shape with the profile of the sloped cam surfaces 45 of the rotary cam 44. The rotary cam 44 is formed integrally with an upper end of the lever portion 40*a* of the lock lever 40. The lever portion 40*a* has a generally rectangular plate-like configuration having a width in a direction parallel to the axis of rotation of the rotary cam 44, and a predetermined length. The joint portion 40*b* between the rotary cam 44 and the lever portion 40*a* is reduced in width.

The slide cam 42 has a non-circular central hole 42*a* which is complementary in contour to the non-circular cross-sectional shape of the support shaft 16. The central hole 42*a* is fitted with the support shaft 16 with the conical spring washers 51, 52 disposed between the throttle lever 30 and the slide cam 42, as shown in FIG. 4. The slide cam 42 thus supported on the support shaft 16 is slidably movable in the axial direction of the support shaft 16 while it is prevented from rotating relative to the support shaft 16.

The rotary cam 44 has a circular central hole 44*a* and a tubular shaft 44*b* concentrical with the central hole 44*a* and projecting from the opposite end face of the rotary cam 44 in a direction away from the sloped cam surfaces 45. The central hole 44*a* and the tubular shaft 44*b* are rotatably fitted around the support shaft 16. The top end of the support shaft 16 and a top end of the tubular shaft 44*b* are held in abutment with the retaining seat 17 of the right casing member 11B, and the support shaft 16 is firmly secured to the retaining seat 17 of the right casing member 11B by means of a screw 24 extending through a hole in the retaining seat 17 and threaded into an axial central hole formed in the support shaft 16, as shown in FIG. 4.

A return spring 46 comprised of a torsion coil spring is fitted around the tubular shaft 44*b* of the rotary cam 44. The return spring 46 has one end engaged with the right casing member 11B and the other end engaged with the rotary cam 44 (namely, the lock lever 40 side). With the return spring 46 thus arranged, the lock lever 40 can automatically return to its original released position by the force of the return spring 46 whenever a force tending to urge the lock lever 40 in a locking direction is released.

The thrust cam mechanism 41 of the foregoing construction operates to force the throttle lever 30 against the retaining surface 18 of the left casing member 11A through a cam action produced by coaction of the sloped cam surfaces 43, 45 of the slide and rotary cams 42, 44 and to hold the throttle lever 30 frictionally in a desired position under the bias of the conical spring washers 51, 52 fitted around the support shaft 16.

Figure 6:
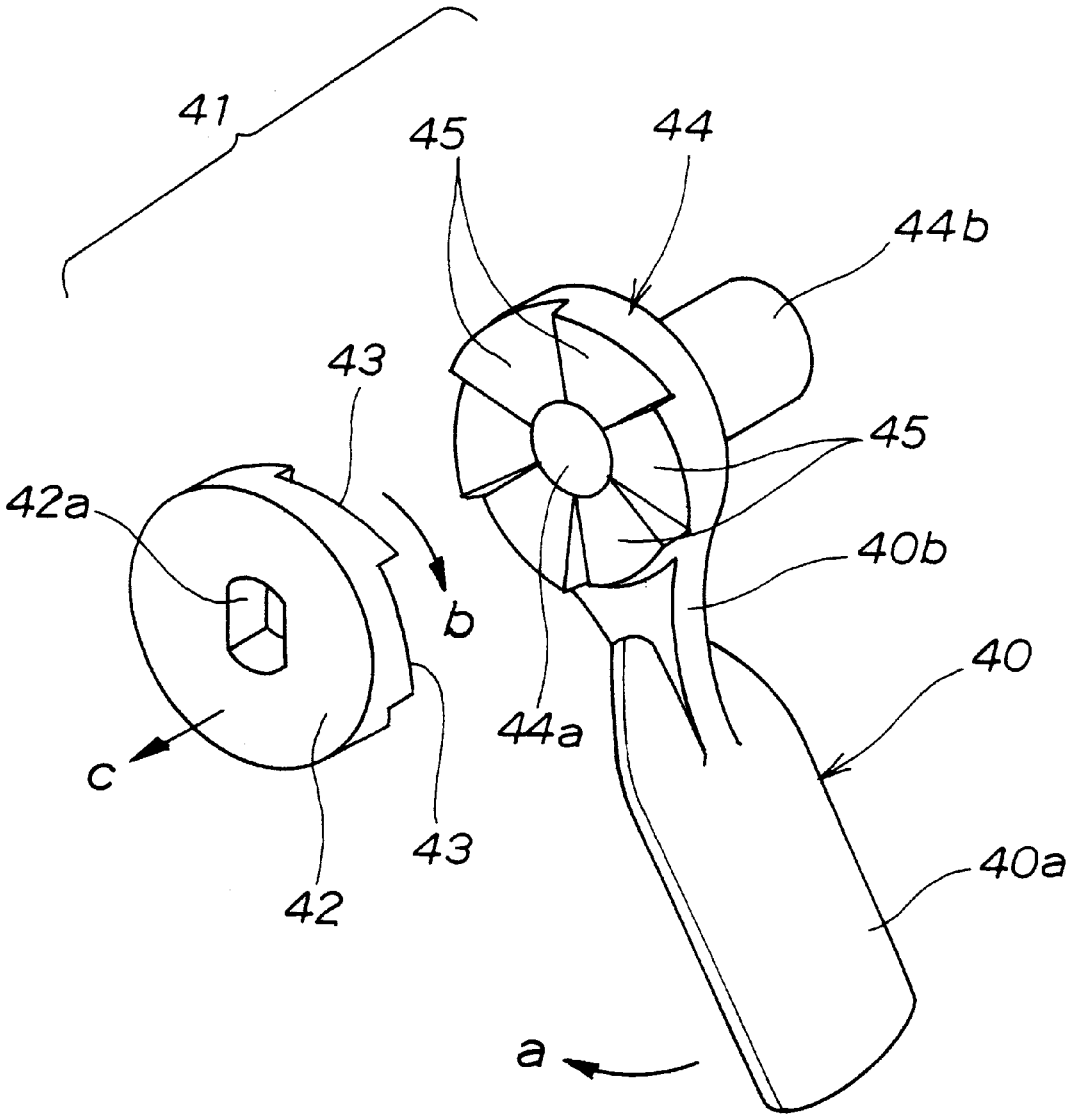
FIG. 6 is an enlarged exploded perspective view of the lock lever and a thrust cum mechanism of the operation lever unit shown FIG. 5.

More specifically, when the lock lever 40 is turned about the support shaft 16 in the direction of the arrow "a" shown in FIG. 6, the rotary cam 44 rotates in the direction of the arrow "b". In this instance, since the slide cam 42 is non-rotatably and slidably supported on the support shaft 16 with its sloped cam surfaces 43 held in sliding contact with the sloped cam surfaces 43 of the rotary cam 44, rotation of the rotary cam 44 causes the sloped cam surfaces 45 and the slide cam 42 to move toward the direction of the arrow "c" against the force of the conical spring washers 51, 52 (FIG. 4).

The throttle lever 30, the lock lever 40 and the operation handle 10 jointly form an operation lever unit 50 (FIG. 3). The operation handle 10 has an engine start switch 53 attached thereto via the elongated hole 20 formed in the rear side of the head 15.

The throttle lever 30 of the operation lever unit 50 operates as follows.

FIGS. 2 to 4 show the throttle lever 30 and the lock lever 40 in their original released positions. The illustrated condition may appears during use of the bush cutter when the operation handle 10 is gripped at a lower portion of the tubular body 12, or an upper portion of the operation handle 10 including these two levers 30, 40 is not gripped by the operator M (FIG. 1).

In this original released position, the throttle lever 30 which is urged clockwise about the bolt 22 by means of the return spring 36 has a front portion 30*c* projecting forwardly of the head 15 through the elongated hole 19. The lock lever 40 which is urged counterclockwise about the support shaft 16 by means of the return spring 46 has the lever portion 40*a* extending at an angle to the longitudinal axis of the operation handle 10 and spaced far away from the tubular body 12 of the operation handle 10.

When the operation handle 10 is gripped by the right hand RH of the operator M in a manner shown in FIG. 7, the forwardly projecting front portion 30*c* of the throttle lever 30 is depressed by second and third fingers F2 and F3 to thereby turn the throttle lever 30 in the counterclockwise direction about the bolt 22 against the force of the return spring 36, the intermediate portion just below the head 15 of the operation handle 10 is gripped by fourth and fifth fingers F4 and F5, the right side of the operation handle 10 is supported by a palm of the right hand RH, and the lever portion 40*a* of the lock lever 40 is depressed by a ball P of the thumb F1. In this instance, the lock lever 40 is turned clockwise about the support shaft 16 from the released position shown in FIG. 3 to the locking position shown in FIG. 8. When the lock lever 40 is in the locking position, the lever portion 40*a* of the lock lever 40 is fully received in the pocket 13 of the operation handle 10. Since the lever portion 40*a* lies substantially flush with the rear side of the operation handle 10, the operator M can grip the operation handle 10 neatly and stably.

Figure 8:
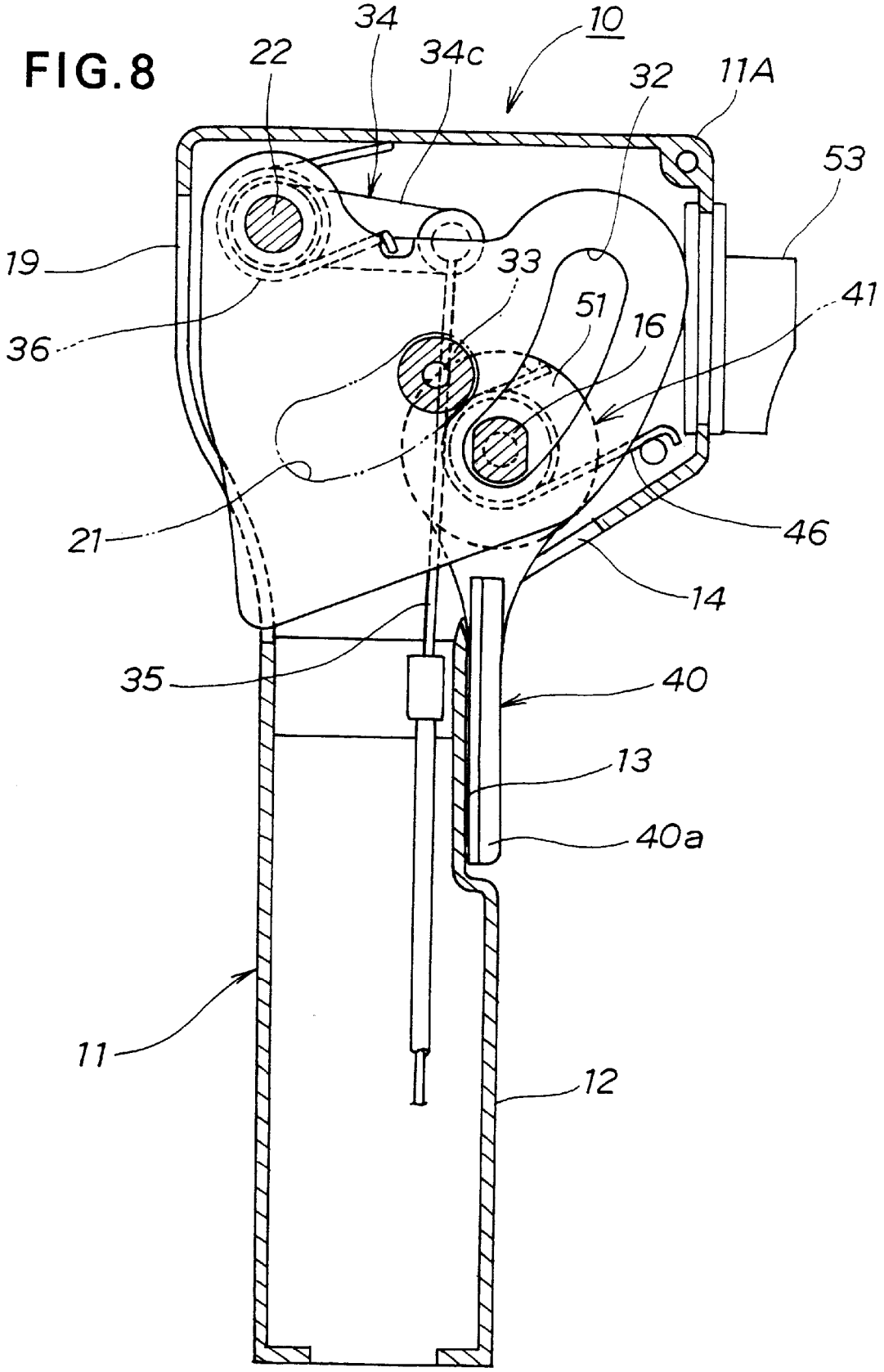
FIG. 8 is a longitudinal cross-sectional view of FIG. 7.

Upon depression of the front portion 30*c* of the throttle lever 30 using the second and third fingers F2, F3, the throttle lever 30 turns counterclockwise about the bolt 22 to move from the original position shown in FIG. 3 to the operating position shown in FIG. 8. The range of pivotal movement of the throttle lever 30 is limited by engagement between opposite ends of the arcuate guide hole 32 and the support shaft 16. In other words, the throttle lever 30 is pivotally movable about the bolt 22 within an angular range determined by the length of the arcuate guide hole 32.

The secondary throttle adjustment lever 37 is firmly connected to the throttle lever 30 as described above. Accordingly, gripping of the operation handle 10 to turn the throttle lever 30 in the counterclockwise direction causes the secondary throttle adjustment lever 37 to move from the lowermost original position shown in FIGS. 2 and 3 in which the adjustment lever 37 is located at one end (lower end) of the arcuate guide hole 21, to the uppermost operating position shown in FIGS. 7 and 8 in which the adjustment lever 37 is located at the other end (upper end) of the arcuate guide hole 21.

As the throttle lever 30 turns about the bolt 22 in the counterclockwise direction from the position shown in FIG. 3, the throttle control cable 35 is pulled upwardly, as shown in FIG. 8. The upward movement of the throttle control cable 35 causes the throttle valve of the engine 3 (FIG. 1) to open widely, thereby increasing power of the engine 3 and rotational speed of the cutter 6 (FIG. 1). When the throttle lever 30 is in the position shown in FIGS. 7 and 8, the engine 3 runs with a maximum power and the cutter 6 is rotated at a maximum speed.

When the lock lever 40 is gripped by the right hand RH together with the control handle 10, the lock lever 40 is turned to angularly move the rotary cam 44 of the thrust cam mechanism 41 about the support shaft 16 through a predetermined angle. With this angular movement of the rotary cam 44, a peak of each of the sloped cam surfaces 45 climbs a corresponding one of the sloped cam surfaces 42 of the slide cam 42, thereby forcing the slide cam 42 to slide along the support shaft 16 toward the throttle lever 30 against the force of the conical spring washers 51, 52.

With this sliding movement of the slide cam 42, the conical spring washers 51, 52 are forced leftwards in FIG. 4 and, hence, the throttle lever 30 disposed on the left side of the conical spring washers 51, 52 is forced against the retaining surface 18 of the left casing member 11A by the resiliency of the conical spring washers 51, 52

Thus, by depressing the lock lever 40 toward the tubular body 12 of the operation handle 10 by using the ball P of the thumb F1, the throttle lever 30 is forced against the retaining surface 18 of the left casing member 11A and frictionally held or locked in a desired position against movement relative to the operating handle 10.

This throttle lever holding condition is provided with no reliance upon interlocking engagement between the lock lever 40 and the throttle lever 30 but is achieved by frictional engagement between the lock lever 30 and the retaining surface 18 of the handle 10 which is caused by a thrusting action of the cam mechanism 41 via the conical spring washers 51, 52 in response to pivotal movement of the lock lever 40. Since by gripping the levers 30, 40 together with the operation handle 10 using the right hand RH of the operator M, the throttle lever 30 is automatically brought to the frictionally locked condition described above, it becomes possible to perform a bush-removing work with utmost ease by simply moving the operating rod 5 (FIG. 1) in the usual manner. During the bush-removing work, the circular cutter 6 is continuously driven at a constant speed as long as the operation handle 10 is gripped operator M. The operator M is freed from a delicate action which is conventionally needed to hold the throttle lever 30 in a desired position.

Figure 7:
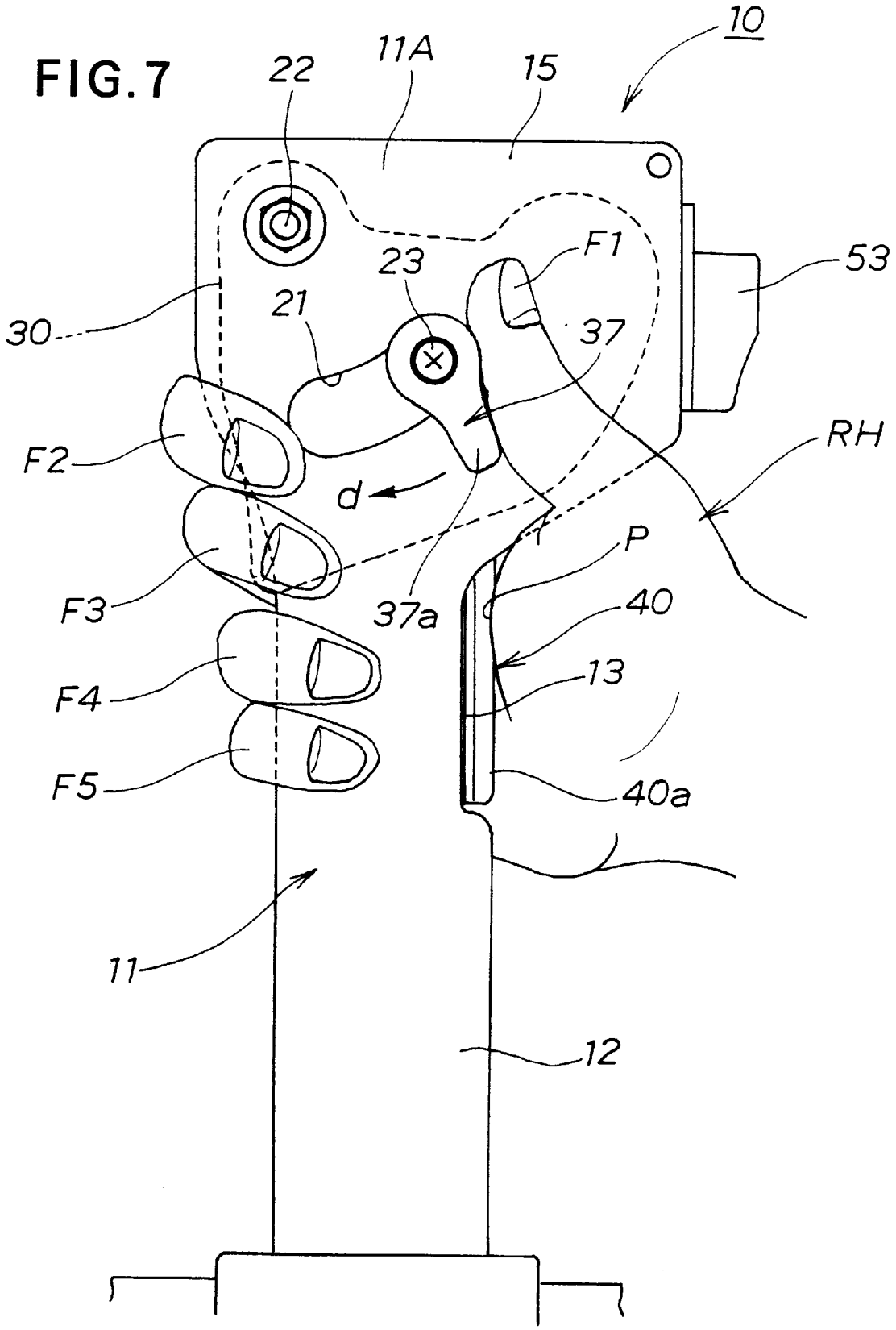
FIG. 7 is a view similar to FIG. 2, showing the operation lever it in its locked position.

The throttle lever 30 shown in FIGS. 7 and 8 is in the full-throttle position where the throttle valve of the engine 3 (FIG. 1) is fully opened to thereby rotate the circular cutter 6 at a maximum speed. Occasionally, the rotational speed of the cutter 6 is to be slowed down by restricting the opening of the throttle valve. In this case, the thumb F1 of the right hand RH is placed on the lever portion 37*a* of the secondary throttle adjustment lever 37 and forcibly moves the secondary throttle adjustment lever 37 in the direction of the arrow "d" shown in FIG. 7. Since the thumb F1 does not take part in the gripping of the operation handle 10 and the depression of the two levers 30, 40, actuation of the secondary throttle adjustment lever 37 using the thumb F1 does not affect firm gripping of the operation handle 10. Additionally, since the thumb F1 is permitted to move freely, it can displace the secondary throttle adjustment lever 37 with high accuracy.

When the secondary throttle adjustment lever 37 is forcibly displaced by the thumb F1 in the direction of "d" shown in FIG. 1, the throttle lever 30 turns clockwise about the bolt 22 even though the lock lever 40 is held in the locking position. Since the throttle lever 30 is held in a desired position (such as the full-throttle position shown in FIG. 7) only by a frictional force acting between the throttle lever 30 and the retaining surface 18 (FIG. 3) of the left casing member 11A under the action of the cam mechanism 41, the throttle lever 30 can start moving in the clockwise direction while sliding on the retaining surface 18 when the force or pressure applied by the thumb F1 onto the secondary throttle adjustment lever 37 exceeds the frictional force between the throttle lever 30 and the retaining surface 18. With this movement of the throttle lever 30, the throttle valve varies its vale opening from the full-throttle position to an intermediate throttle position, thus lowering the rotational speed of the circular cutter 6 (FIG. 1) to meet the underlying conditions of the bush-removing work. In this instance, because the direction of movement of the secondary adjustment lever 37 (indicated by the arrow "d" in FIG. 7) is identical with a direction of movement of the thumb F1 in which the thumb F1 can apply a greater force than as it moves in the opposite direction, the secondary throttle adjustment lever 37 is actuated easily and stably.

When the throttle valve is to be returned to the full-throttle position, the pressure on the secondary throttle adjustment lever 37 is removed by separating the thumb F1 from the adjustment lever 37 while the operation handle 10 is being firmly gripped together with the throttle lever 30 and the lock lever 40. Because the position of the throttle valve corresponding to the position of the throttle lever 30 is adjusted while keeping a firm grip on the operation handle 10, the bush-removing operation by the carrying bush cutter 1 is achieved smoothly and efficiently. Thus, the operation lever unit 50 of the present invention is easy to operate, improves the manipulatability of the carrying bush cutter 1, and hence achieves the bush-removing work with improved efficiency.

In the illustrated embodiment, the operation lever unit of the present invention is used in a carrying bush cutter. The illustrated application of the operation lever unit is not restrictive but may include another type of engine-powered portable working machine, such as a liquid-chemical recirculating sprayer, a chain saw, etc.

As described above, the throttle lever unit of the present invention includes a thrusting means or mechanism which is operative, in response to rotation of a lock lever, to resiliently urge a throttle lever against a portion of an operation handle to hold the throttle lever in a desired position by a frictional force acting between the throttle lever and the handle portion. To enable a fine adjustment of the throttle lever, a secondary throttle adjustment lever attached to the throttle lever is displaced by the thumb of a hand of the operator to forcibly turn the throttle lever against the frictional force while the throttle lever and the lock lever are gripped by the same hand together with the operation handle. Since the throttle adjustment is achieved without loosening a firm grip on the operation handle, good manipulatability of the of the operating rod is maintained. Accordingly, a bush-removing work using the carrying bush cutter is achieved smoothly and efficiently. The operation lever unit of the present invention is easy to operate and offers good compatibility between a firm and reliable grip on the operation handle which insures reliable manipulation of the operating rod, and a fine adjustment of the secondary throttle adjustment lever which may hinder stable manipulation of the operating rod.

Obviously, various minor changes and modifications are possible in the light of the above teaching. It is to be understood that within the scope of the appended claims the present invention may be practiced otherwise than as specifically described.

What is claimed is:

1. An operation lever device for regulating the power of an engine of a working machine to control operation of a working tool attached to one end of an operating rod of the working machine, said operation lever unit comprising:

an operation handle provided on an opposite end portion of said operating rod and having a retaining surface and a support shaft extending perpendicularly from said retaining surface:

a throttle lever having an end pivotally connected to said operation handle and extending over said retaining surface, said throttle lever being pivotally movable about said pivoted end within a predetermined angular range;

a lock lever pivotally supported on said support shaft, said lock lever for locking said throttle lever against said retaining surface;

a thrusting means disposed between said throttle lever and said lock lever and responsive to pivotal movement of said lock lever for forcing said throttle lever against said retaining surface to frictionally hold said throttle lever in a desired position; and a secondary throttle adjustment lever provided on said throttle lever for forcibly turning said throttle lever against a frictional force acting between said throttle lever and said retaining surface of said operation handle.

2. An operation lever device according to claim 1, wherein said operation handle extends perpendicularly from a longitudinal axis of said operating rod, said throttle lever is disposed on one side of said operation handle which faces toward said working tool, said lock lever is disposed on an opposite side of said operation handle which faces away from said working tool, and said secondary throttle adjustment lever is disposed on a surface of said operating handle extending substantially parallel to said longitudinal axis of said operating rod.

3. An operation lever unit according to claim 1, wherein said operation handle has a pocket for receiving therein a lever portion of said lock lever.

4. An operation lever unit according to claim 1, wherein said thrusting means includes a rotary cam integral with said lock lever and rotatably mounted on said support shaft, and a slide cam slidably and non-rotatably mounted on said support shaft, said slide cam being disposed between said throttle handle and said rotary cam and having a cam surface, said rotary cam having a cam surface coacting with said cam surface of said slide cam to move said slide cam along said support shaft in a direction toward said retaining surface when said rotary cam is rotated by said lock lever.

5. An operation lever unit according to claim 4, wherein said thrusting means further includes a resilient member disposed between said throttle lever and said slide cam for urging them away from each other.

6. An operation lever unit according to claim 5, wherein said resilient member is a pair of conical spring washers fitted around said support shaft in confrontation to one another.

* * * * *